US008469040B2

(12) United States Patent
Flowers

(10) Patent No.: US 8,469,040 B2
(45) Date of Patent: Jun. 25, 2013

(54) HEAT RETAINING CURLING SYSTEM AND METHOD OF STYLING

(75) Inventor: Linda Flowers, Los Angeles, CA (US)

(73) Assignee: Linda Flowers, Los Angeles, CA (US)

( * ) Notice: Subject to any disclaimer, the term of this patent is extended or adjusted under 35 U.S.C. 154(b) by 0 days.

(21) Appl. No.: 13/165,574

(22) Filed: Jun. 21, 2011

(65) Prior Publication Data

US 2011/0271977 A1 Nov. 10, 2011

Related U.S. Application Data

(62) Division of application No. 12/056,669, filed on Mar. 27, 2008, now Pat. No. 8,327,860.

(60) Provisional application No. 60/907,265, filed on Mar. 27, 2007.

(51) Int. Cl.
*A45D 7/02* (2006.01)
*A45D 1/02* (2006.01)

(52) U.S. Cl.
USPC ..... 132/211; 132/210; 132/233

(58) Field of Classification Search
USPC ..... 132/200, 202, 203, 205–207, 210, 132/211, 273, 276, 277, 220, 233, 234, 236; 219/225, 226
See application file for complete search history.

(56) References Cited

U.S. PATENT DOCUMENTS

| | | | |
|---|---|---|---|
| 1,972,186 | A | 9/1934 | Davis |
| 2,133,573 | A | 10/1938 | Rifle |
| 2,161,202 | A | 6/1939 | Schleimer |
| 2,491,939 | A | 12/1949 | Tasho |
| 2,517,253 | A | 8/1950 | Spaeth |
| 3,380,720 | A | 4/1968 | Bauer |
| 3,858,029 | A | 12/1974 | Walter |
| 3,889,097 | A | 6/1975 | Forsberg |
| 3,946,196 | A | 3/1976 | Waters et al. |
| 4,254,324 | A | 3/1981 | Vrtaric |
| 4,661,683 | A | 4/1987 | Glucksman |
| 5,294,777 | A | 3/1994 | Denhup |
| 5,522,407 | A | 6/1996 | Kelsey |
| 5,873,377 | A | 2/1999 | Yang |
| D552,793 | S | 10/2007 | Pichon |
| 7,631,649 | B2 | 12/2009 | Coral et al. |
| 2005/0056297 | A1 | 3/2005 | Maione |
| 2005/0087205 | A1 | 4/2005 | Rizzuto |
| 2007/0209763 | A1 | 9/2007 | Chen |
| 2008/0236606 | A1 | 10/2008 | Flowers |

OTHER PUBLICATIONS printout from www.remingtonproducts.com.
printout from www.conair.com.
International Search Report dated Apr. 5, 2012.

*Primary Examiner* — Rachel Steitz
(74) *Attorney, Agent, or Firm* — Laura M. Lloud; Jeffrey G. Sheldon; Sheldon Mak & Anderson

(57) ABSTRACT

An improved hair styling device comprises heating elements and heat retaining clips inside the device's housing. The clips present concave inner faces, and form an enclosed space when in a closed position. A heat retaining means with an elevated heat capacity is incorporated into the clips adjacent the inner surface of the jaws of the clips; and also presents a concave surface to the inside of the clips when in a closed position. The heating elements comprise elongated heating rods with multiple heating locations along their length. Each heating location comprises an enlarged convex area on the surface of the heating rods. The heating locations are complimentary to the shape of the heat retaining means, and therefore heat the clips quickly and evenly.

5 Claims, 5 Drawing Sheets

10
14
40
14
40

HEAT RETAINING CURLING SYSTEM AND METHOD OF STYLING

CROSS-REFERENCE TO RELATED APPLICATION

This application is a divisional of U.S. patent application Ser. No. 12/056,669, filed on Mar. 27, 2008 now U.S. Pat. No. 8,327,860, that claims the benefit of the priority date of provisional application No. 60/907,265 filed on Mar. 27, 2007, the entire disclosures of which are incorporated by reference in their entirety for any and all purposes.

BACKGROUND

Heated curling products and heated curling clips are known in the art.

U.S. Pat. No. 5,522,407 to Kelsey discloses a heated hair clip with heatable plates mounted for universal movement to be used in connection with U-shaped hair curlers.

U.S. Pat. No. 5,294,777 to Denhup discloses a hair clip with plates for storing and releasing heat, and lateral supports for styling hair perpendicular to the scalp.

The heated curling clips of the current state of the art adjoin strands of hair, and apply direct pressure. These methods result in damaged hair follicles due to the heat and pressure exerted on hair follicles. Additionally, they result in a specific type of hair style unlike that of the instant invention.

Due to the limitations of these devices there is a need for a clip-type hair styling device wherein the clips have heat storage characteristics that avoid hair damage, and which can be used to create styles of hair comprising, in particular, loose waves and curls. hair, and apply direct pressure. These methods result in damaged hair follicles due to the heat and pressure exerted on hair follicles. Additionally, they result in a specific type of hair style unlike that of the instant invention.

Due to the limitations of these devices there is a need for a clip-type hair styling device wherein the clips have heat storage characteristics that avoid hair damage, and which can be used to create styles of hair comprising, in particular, loose waves and curls.

It is therefore an object of the present invention to provide a device employing clips for styling hair, comprising a heating means and a series of heatable clips. It is a further object of the invention to provide a clip-type that does not cause damage to the hair by overly constraining or heating it. Another object of the invention is to provide a heat retaining means incorporated into the clips.

Finally, it is an object of the present invention to provide a heated hair clip device wherein the clips provide a heated space containing loosely constrained hair, thereby imparting a temporary shape to the hair when removed from a clip.

SUMMARY

An improved hair curling device comprises a housing containing heating elements and a series of heat retaining clipping means. The clipping means comprises a pair of hinged opposing jaws biased to a closed position. The jaws present facing concave inside surfaces to each other in a manner that creates a confined space between the jaws with the clipping means in a closed position.

The clipping means further comprises a heat retaining means attached to the inside surfaces of the clipping means. The heat retaining means is disposed on the inside of the clipping means, and has an elevated heat capacity.

The heating elements of the device comprise members with a series of convex surface areas disposed along their length. The convex areas are complimentary to the concave inner surfaces of the clipping means and heat retaining means in such a manner that when a clipping means is disposed on a heating element, the heat retaining means is in complete contact with the convex surface, thereby heating the heat retaining means quickly and evenly.

In order to employ the apparatus and method of the present invention, a user activates the hair curling device and heats the clipping means installed on the heating elements. To style hair, a user then compiles assemblages of curls. An assemblage of curls may comprise circular or FIG. 8 patterns by winding groups of strands of hair around one or more fingers of the user. For simple curls, the fingers of a user are removed while preserving the integrity of the assemblage of curls. Thereafter, a heated clipping means is placed over the assemblage of hair in a manner that the assemblage is contained in the space between the heat retaining means.

After the heated hair clamp remains in place for a predetermined amount of time, it is removed from the hair assemblage, which will retain a curled shape for a period of time. An alternative method creates figure eight curls. A user holds a set of hair strands between the thumb and forefinger. The strands are wrapped a half turn around the forefinger, and pulled toward the middle finger. Then the strands are wrapped around the middle finger and pulled back toward the forefinger to cross. The strands are then wrapped around the forefinger and back to the middle finger so that they cross again and the process is repeated until the entire length of the hair strand comprises a figure eight assemblage. The assemblage can then be inserted into a heated clipping means.

FIGURES

DESCRIPTION

Figure 1:
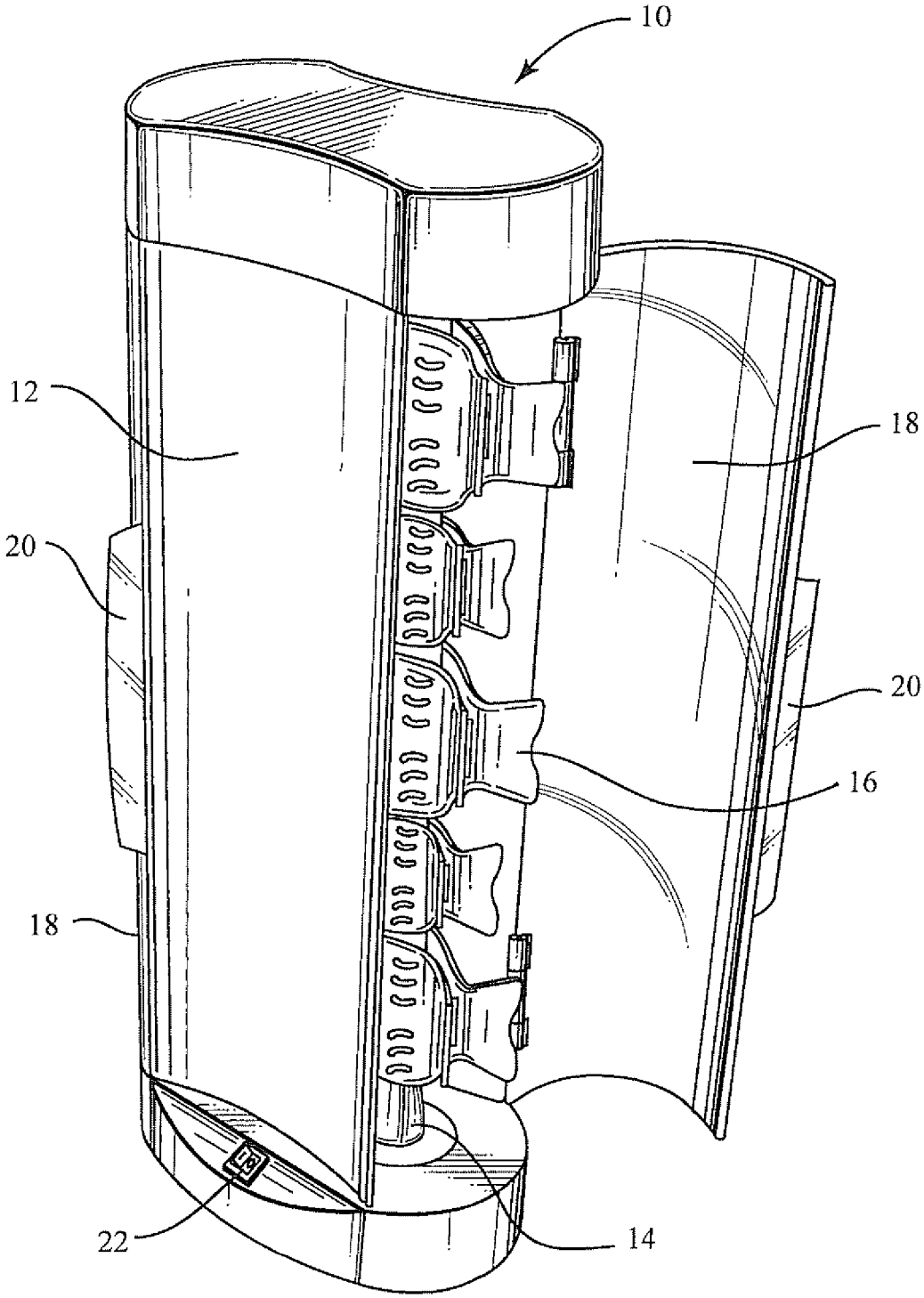
FIG. 1 is a perspective view of the device of the present invention with one door open revealing a plurality of heated clipping means.

Referring to FIG. 1, an improved hair curling device is shown and described. The hair curling device 10 comprises a housing 12 for containing and enclosing heating elements 14 and a series of heat retaining clips 16. The heating elements 14 and heat retaining clips 16 are enclosed in the housing 12 by means of access panels or doors 18. The doors 18 may be opened to allow access to the heated clips 16, and otherwise kept closed to retain heat in the housing 12. A handle means 20 is used to open the doors 18.

In a preferred embodiment, the heating elements 14 within the housing 12 are powered electrically, wherein the housing further comprises an on/off switch 22 on its exterior surface. In another preferred embodiment, the housing 12 accommodates clips of varying sizes for achieving a variety of hair styles. Although in the illustrated embodiment, the housing 12 contains two heating elements, in additional preferred embodiments, single or multiple heating elements are contemplated.

Figure 2:
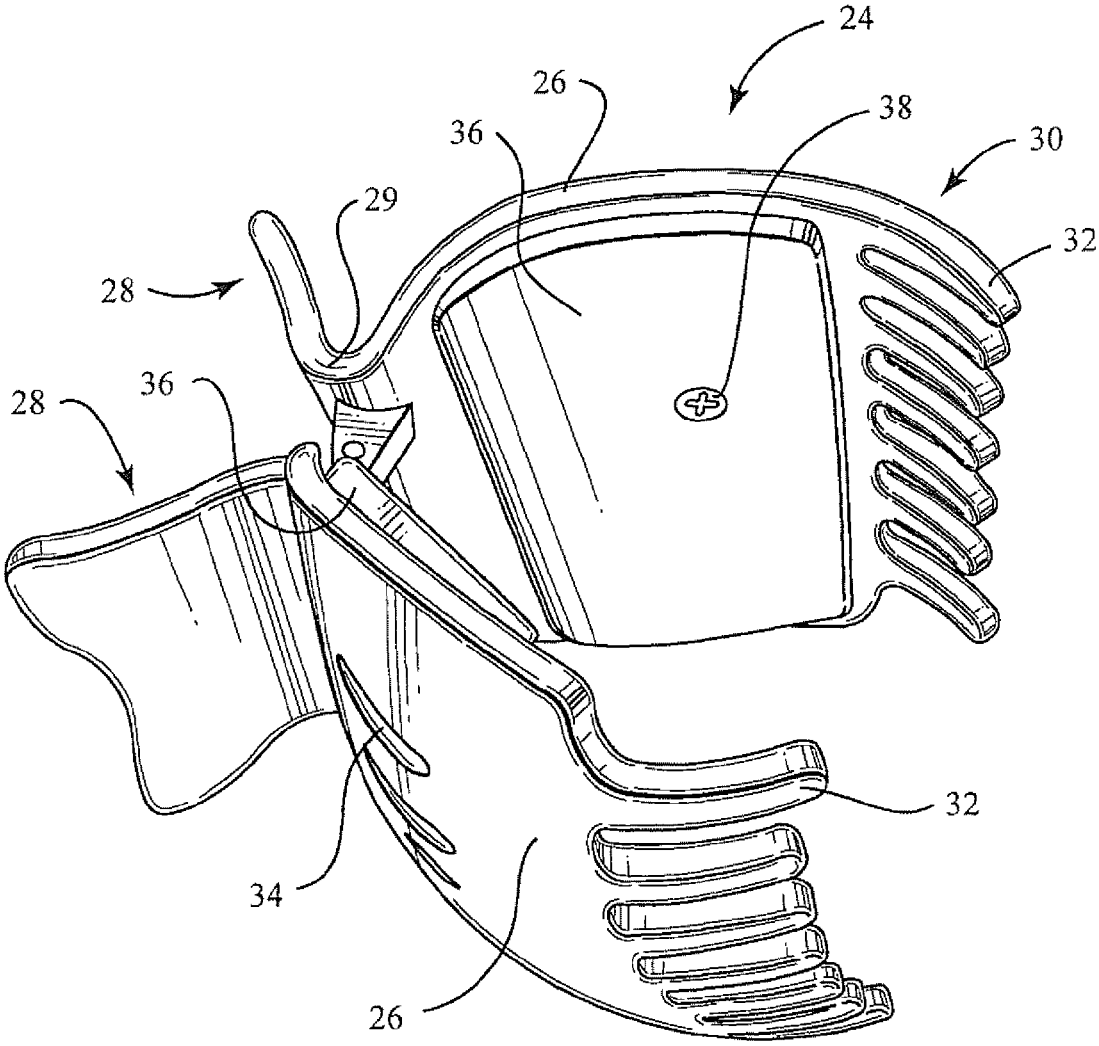
FIG. 2 is a perspective view of the clipping means of the device.

Referring to FIG. 2, the clipping means 24, comprises a pair of hinged opposing jaws 26 biased to a closed position. The jaws 26 present facing concave inside surfaces to each other in a manner that creates a confined space between the jaws when the clipping means 24 is in a closed position. The jaws 26 comprise a proximal end 28 with a bend 29 for opening the clipping means 24 and a distal end 30 comprising a series of teeth 32 forming two interlocking combs. In one preferred embodiment, a series of vents 34 is disposed in the jaws 26 to allow excess heat to escape.

Still referring to FIG. 2, the clipping means 24 further comprises a heat retaining means 36 attached to the inside surfaces of the jaws 26. The heat retaining means 36 is adjacent to, and comprises the same concave surface characteristic as the inside surface of the jaws 26. In one preferred embodiment, the heat retaining means comprises ceramic material. In another preferred embodiment, the heat retaining means 36 is attached to the jaws 26 with a screw means 38.

Figure 3:
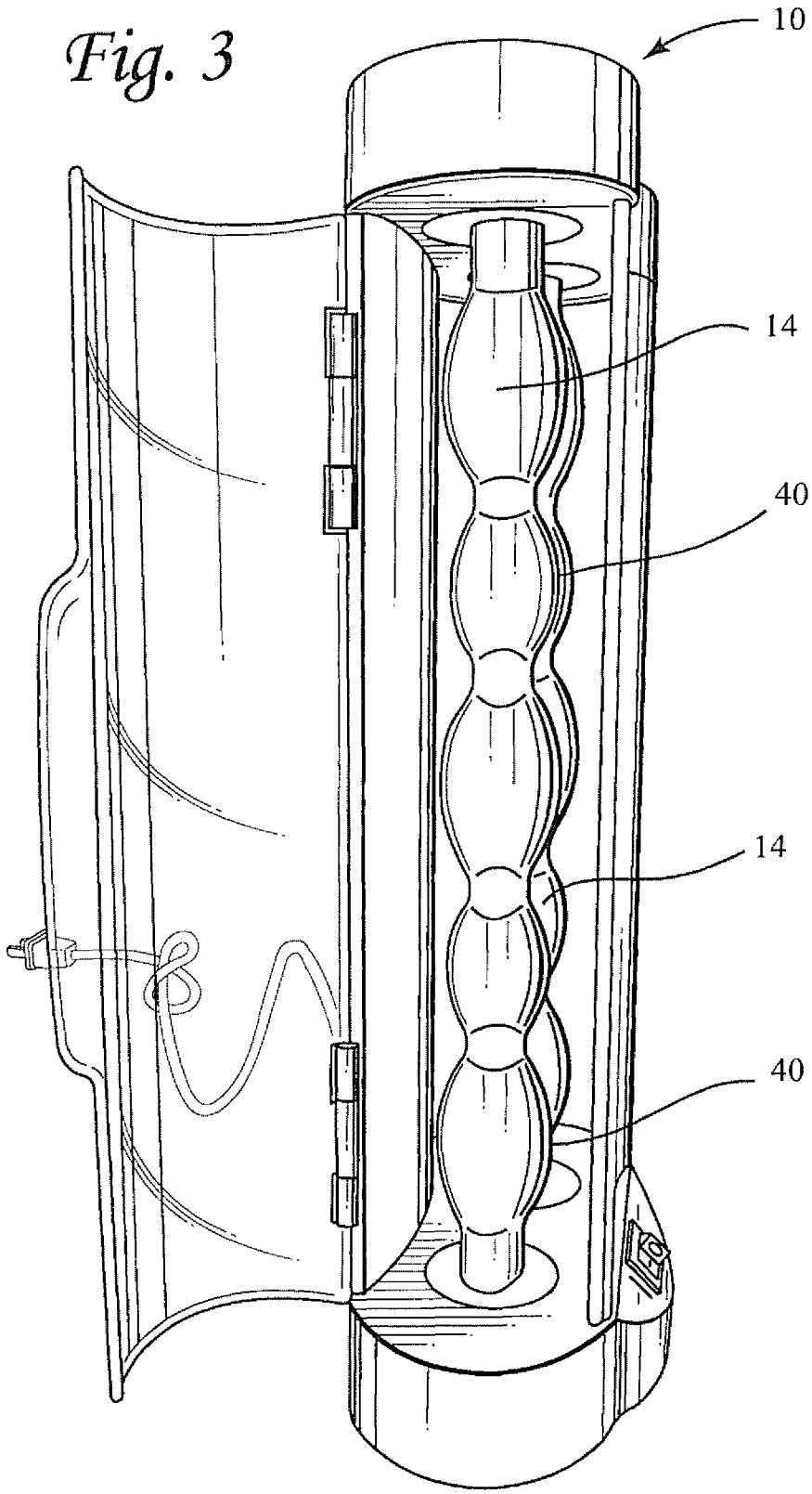
FIG. 3 is a perspective view of the device without clipping means attached.

Referring to FIG. 3, the device 10 is shown without the clipping means attached. The heating elements 14 of the device 10 comprise elongated members with a series of convex surface characteristics 40 disposed along their length. The convex surface characteristics 40 are complimentary to the concave inner surfaces of the jaws and heat retaining means so that when a clipping means 24 is disposed on a heating element 14, the heat retaining means 24 is in complete contact with the convex surface 40, thereby heating the heat retaining means 24 quickly and evenly. In further preferred embodiments, the heating elements 14 may be thermostatically controlled for achieving variable temperatures.

Figure 4:
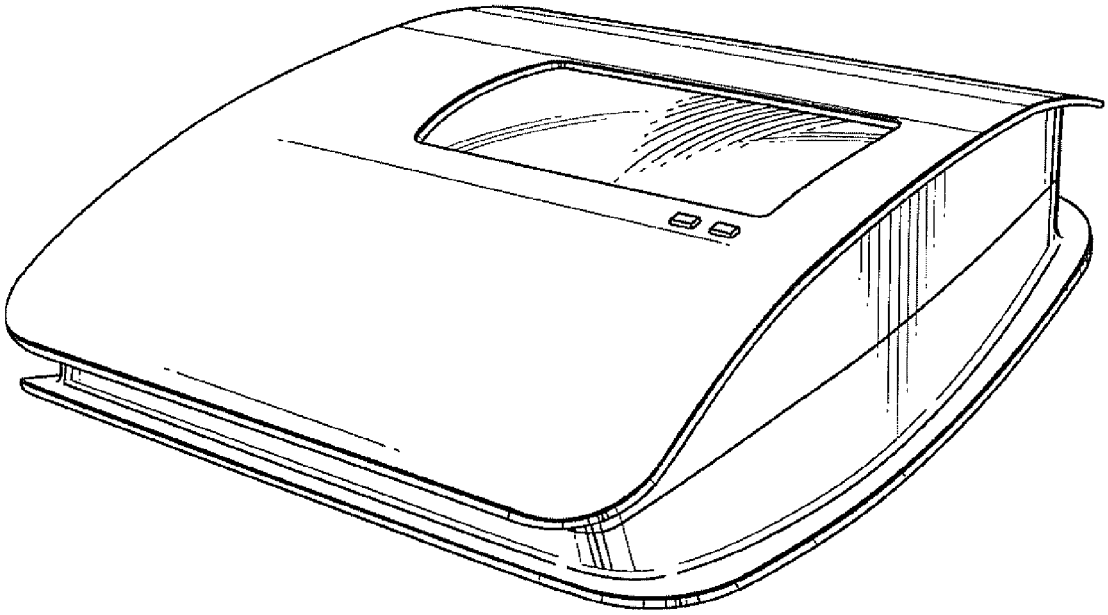
FIG. 4 is a perspective view of an alternative embodiment with a lower profile and horizontal heating elements.
Figure 5:
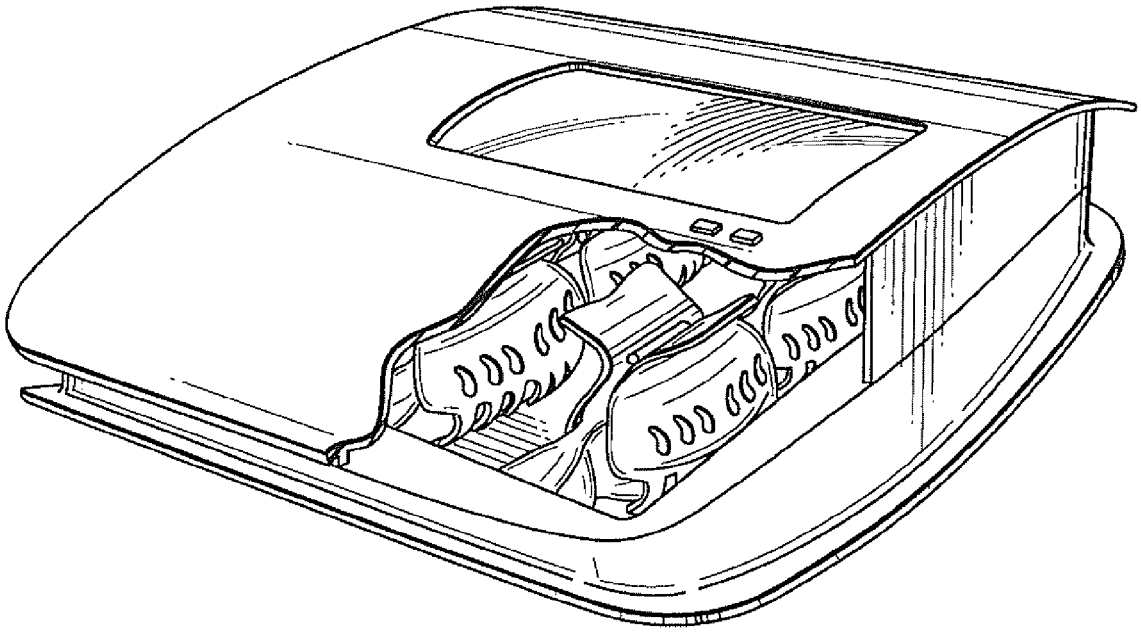
FIG. 5 is a perspective view of an alternative embodiment with the lid open.

In one preferred embodiment, the heating elements 14 are disposed in the housing 12 in a vertical configuration. Referring to FIGS. 4 and 5, an alternative embodiment of the invention is shown in which the heating elements are disposed in a horizontal configuration in a housing designed for a lower profile.

In order to employ the apparatus and method of the present invention, a user activates the hair curling device with the clipping means installed on the heating elements, thereby heating the clipping means. After a predetermined amount of time, the clipping means will arrive at the temperature governed by the device.

Strands of hair are then compiled into an assemblage of curls. An assemblage of hair may comprise circular or FIG. 8 curls by winding groups of strands of hair around one or more fingers of the user. For simple curls, the fingers of a user are removed while applying a heated clipping means to preserve the integrity of the assemblage of curls. Thereafter, the assemblage of hair is contained in the space between the heat retaining means.

After a predetermined amount of time, the clipping means is removed and the assemblage of hair will temporarily retain the curled shape. In alternate embodiments, a rod-shaped member may be used in lieu of fingers.

To make figure eight curls, a user holds a first set of hair strands at the ends of the strands between the thumb and forefinger wrapped one half turn around the forefinger, and pulled toward the middle finger. The strands are wrapped around the middle finger and back toward the forefinger, crossing. The strands are then wrapped around the forefinger and back to the middle finger so that they cross again. This process is repeated until the entire length of the hair strands comprises a figure eight assemblage. This assemblage can then be inserted into a clipping means.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. .sctn. 112, paragraph 6. In particular, the use of "step of" in the claims herein is not intended to invoke the provisions of 35 U.S.C. .sctn. 112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. The method of curling hair comprising the steps of:

a. heating a hair clip, the clip comprising a pair of biasable opposing jaws having an open position and a closed position, each jaw having double concave inside surfaces forming a bowl shape therebetween and creating a confined space between the jaws when in the closed position;

b. forming an assemblage of hair comprising figure eight curls;

c. placing the heated hair clip directly over the assemblage of hair;

d. allowing the heated clip to remain on the assemblage of hair in the closed position for a sufficient time that the assemblage of hair retains a curled shape when the clip is removed; and e. after step (d), removing the clip from the assemblage of hair.

2. The method of claim 1, wherein the figure eight curl is formed by the steps of:

a. holding a plurality of hair strands at the ends of the strands between two fingers;

b. wrapping the plurality of strands of hair one half turn around the first finger;

c. pulling the strands toward a third finger and wrapping the strands one full turn around the third finger;

d. pulling the strands from the third finger back toward the first finger in a manner that causes the strands from the first finger to cross the strands from the third finger;

e. wrapping the strands around the first finger and pulling them back toward the third finger so that they cross again; and f. continuing this procedure for the entire length of the hair strands.

3. The method of claim 1, wherein the figure eight curl is formed by the steps of:

a. holding a plurality of hair strands at the roots of the strands between two fingers;

b, wrapping the plurality of strands of hair one half turn around the first finger;

c. pulling the strands toward a third finger and wrapping the strands one full turn around the third finger;

d. pulling the strands from the third finger back toward the first finger in a manner that causes the strands from the first finger to cross the strands from the third finger;

e. wrapping the strands around the first finger and pulling them back toward the third finger so that they cross again; and f. continuing this procedure for the entire length of the hair strands.

4. The method of claim 1 wherein the clip comprises a heat retaining element attached to the inside surfaces of the jaws, adjacent to, and comprising the same shape as the inside surface of the jaws.

5. The method of claim 1, wherein the hair is damp when formed into an assemblage.

* * * * *